US005883329A

United States Patent [19]

O'Dwyer

[11] Patent Number: 5,883,329

[45] Date of Patent: Mar. 16, 1999

[54] BARREL ASSEMBLY

[76] Inventor: James Michael O'Dwyer, 12 Peppertree Street, Sinnamon Park, Queensland 4073, Australia

[21] Appl. No.: 525,705

[22] PCT Filed: Mar. 14, 1994

[86] PCT No.: PCT/AU94/00124

§ 371 Date: Sep. 12, 1995

§ 102(e) Date: Sep. 12, 1995

[87] PCT Pub. No.: WO94/20809

PCT Pub. Date: Sep. 15, 1994

[30] Foreign Application Priority Data

| | | | |
|---|---|---|---|
| Mar. 12, 1993 | [AU] | Australia | PL7773 |
| May 19, 1993 | [AU] | Australia | PL8876 |
| Sep. 15, 1993 | [AU] | Australia | PM1201 |
| Dec. 9, 1993 | [AU] | Australia | PM2868 |
| Jan. 12, 1994 | [AU] | Australia | PM3314 |

[51] Int. Cl.[6] ..... F41B 19/68

[52] U.S. Cl. ..... 102/217; 89/1.41; 89/28.05; 42/84

[58] Field of Search ..... 102/472, 217; 89/1.41, 28.05, 8; 42/84

[56] References Cited

U.S. PATENT DOCUMENTS

| | | | |
|---|---|---|---|
| 2,313,030 | 3/1943 | Tauschek | 42/84 |
| 3,169,333 | 2/1965 | Scanlon, Jr. | 42/84 |
| 3,854,231 | 12/1974 | Broyles | 42/84 |
| 4,709,615 | 12/1987 | Field | 89/28.05 |
| 5,133,242 | 7/1992 | Witt | 89/8 |

FOREIGN PATENT DOCUMENTS

| | | | |
|---|---|---|---|
| 1534134 | 11/1978 | United Kingdom | 102/217 |

*Primary Examiner*—Stephen M. Johnson
*Attorney, Agent, or Firm*—Amster, Rothstein & Ebenstein

[57] ABSTRACT

A barrel assembly (10) includes barrel (12), projectile assemblies (14) axially disposed within the barrel, propellant charges (16), ignition means (18), and control means (20). Projectile assemblies (14) are sequentially fired from the barrel. Also disclosed is an arming system, a barrel construction, means for preventing compression of the propellant charges and means for ensuring sealing between the projectile assembly and the barrel.

26 Claims, 11 Drawing Sheets

BARREL ASSEMBLY

BACKGROUND OF THE INVENTION

The invention relates to firearms.

The invention has utility as an automatic, high rate of fire, firearm whereby it may be used for example, as a close-in ship-board defense against bombs, missiles or attack aircraft for launching large numbers of projectiles within a short period of time. The invention also has utility in hand guns such as a rapid fire pistol or rifle which may be disposable.

Currently, most firearms use cartridge ammunition which is mechanically fed to a barrel. Such firearms have numerous moving parts, tend to be heavy and complex, may jamb or be unreliable, and require elaborate delivery and loading systems to support the rate of fire. The rate of fire of automatic firearms of this type is limited by the time required to load the cartridge, seal the barrel, unseal the barrel and eject the empty case.

More recently, firearms have begun to utilise caseless ammunition which obviates the need to eject an empty case subsequent to firing. However, these firearms retain many of the problems of conventional firearms.

SUMMARY OF THE INVENTION

The present invention aims to provide an alternative system which will alleviate at least one of the disadvantages of the prior art.

According to one aspect this invention provides a barrel assembly including:

a barrel;

a plurality of projectile assemblies axially disposed within the barrel for operative sealing engagement with the bore of the barrel;

discrete propellant charges for propelling respective projectile assemblies sequentially through the muzzle of the barrel;

ignition means for igniting the discrete propellant charges; and control means for selectively and sequentially actuating the ignition means.

The ignition means may be electrical, chemical, mechanical or any other conventional primer. Conveniently, the ignition means is electrical and the control means is an electrical control adapted to provide electrical ignition pulse to the respective ignition means. Suitably the control means is configured to enable a user to selectively control the rate, number, and frequency of the pulses to provide a desired firing pattern. The control means may fire the projectile assemblies singly, in pairs, or in any other combinations.

The projectile assembly may be round, conventionally shaped or dart-like and the fins thereof may be off-set to generate a stabilising spin as the dart is propelled from a barrel which may be a smooth-bored barrel. In addition the barrel assembly may find utility as a removable/replaceable barrel of a rifle or pistol.

Alternatively the barrel assembly constitutes one of a plurality of barrel assemblies and the control means may actuate the ignition means of each of the barrel assemblies in such manner that a sequential plurality of arrays of projectile assemblies are propelled in following relationship. Aiming and firing of the arrays of projectile assemblies may be controlled by a conventional radar fire control system or other known fire control systems. The individual barrel assemblies may be aimed such that the array of projectile assemblies converges at a particular range to give a maximum density of projectile assemblies at that range.

Alternatively, the array of projectile assemblies may diverge to maximise coverage of an area. Thus, the average separation distance at the target between the projectile assemblies in an array can be predetermined and adjusted to suit the nature and range of the target. Of course, the individual barrel assemblies may be fired randomly or independently of the other barrel assemblies.

The plurality of projectile assemblies may be disposed in a continuous abutting relationship throughout the barrel either by the projectile assemblies abutting one another or abutting column means intermediate the projectile assemblies to form a compression resistant column able to resist compression of the projectile assemblies or propelling charges associated therewith due to pressure generated by the firing of the leading projectile assemblies.

The propelling charges may be either solid or granular and compression of either may be an undesirable, moreover, movement of the projectile assemblies relative to the barrel may cause misalignment of the ignition means with their respective propellant charges.

It is preferred that the ignition means be disposed at the leading end of the propellant charge so as to minimise possible energy loss in accelerating the front portion of the propellant charge.

It is preferred that each projectile assembly includes a projectile head and extension means for at least partly defining a propellant space. Preferably, the extension means includes a spacer assembly which extends rearwardly from the projectile head and abuts an adjacent projectile assembly.

In one embodiment, the spacer assembly extends through the propellant space and the projectile head whereby compressive loads are transmitted directly through abutting adjacent spacer assemblies. In such embodiment the spacer assembly may add support to the extension means which may be a thin cylindrical rear portion of the projectile head. Furthermore the extension means may form an operative sealing contact with the bore of the barrel to prevent burn leakage past the projectile head.

It is preferred that the spacer assembly includes a rigid collar which extends outwardly to engage a thin cylindrical rear portion of the malleable projectile head in operative sealing contact with the bore of the barrel such that axially compressive loads are transmitted directly between spacer assemblies thereby avoiding deformation of the malleable projectile head.

In another embodiment, complementary wedging surfaces are disposed on the spacer assembly and projectile head respectively whereby the projectile head is urged into engagement with the bore of the barrel in response to relative axial compression between the spacer means and the projectile head. In such arrangement the projectile head and spacer assembly may be loaded into the barrel and thereafter an axial displacement is caused to ensure good sealing between the projectile head and barrel. Suitably the extension means is urged into engagement with the bore of the barrel.

Preferably, the projectile head defines a tapered aperture at its rearward end into which is received a complementary tapered spigot disposed on the leading end of the spacer assembly, wherein relative axial movement between the projectile head and the complementary tapered spigot causes a radially expanding force to be applied to the projectile head.

The barrel may be non-metallic and the bore of the barrel may include recesses which may fully or partly accommodate the ignition means. In this situation the barrel houses electrical conductors which facilitate electrical communication between the control means and ignition means. This arrangement may be utilised for disposable barrel assemblies which have a limited firing life and the ignition means and control wire or wires therefor can be integrally manufactured with the barrel.

In an alternative arrangement, a barrel assembly includes ignition apertures in the barrel and the ignition means are disposed outside the barrel and adjacent the apertures. The barrel may be surrounded by a non-metallic outer barrel which may include recesses adapted to accommodate the ignition means. The outer barrel may also house electrical conductors which facilitate electrical communication between the control means and ignition means. The outer barrel may be formed as a laminated plastics barrel which may include a printed circuit laminate for the ignition means.

Both of the above arrangements lend themselves to a modular or disposable construction. The barrel assemblies may be adapted for firing as is, or may be adapted for mounting within a housing.

For safety, the barrel assembly may include an arming switch associated with each ignition means which is closed in response to the preceding projectile assembly being discharged. Preferably, the arming switch is closed by biasing means which are normally resisted by the preceding projectile assembly. In a preferred embodiment, the projectile head and spacer assembly each constitute switch contacts which are normally electrically isolated from each other and wherein an electrical circuit between the barrel and spacer body is completed in response to the preceding projectile assembly being discharged. In this arrangement, the barrel, which is in electrical contact with the projectile head, is also in contact with one of the electrodes.

In a further aspect this invention resides broadly in a method of defending an airspace, including:

providing a plurality of barrel assemblies substantially as defined above, and sequentially igniting propellant charges in the barrel assemblies in rapid succession to propel sequential arrays of projectile assemblies into the airspace.

BRIEF DESCRIPTION OF THE DRAWINGS

In order that this invention may be more readily understood and put into practical effect, reference will now be made to the accompanying drawings which illustrate typical embodiments of the invention and wherein.

DESCRIPTION OF THE PREFERRED EMBODIMENT

Figure 1:
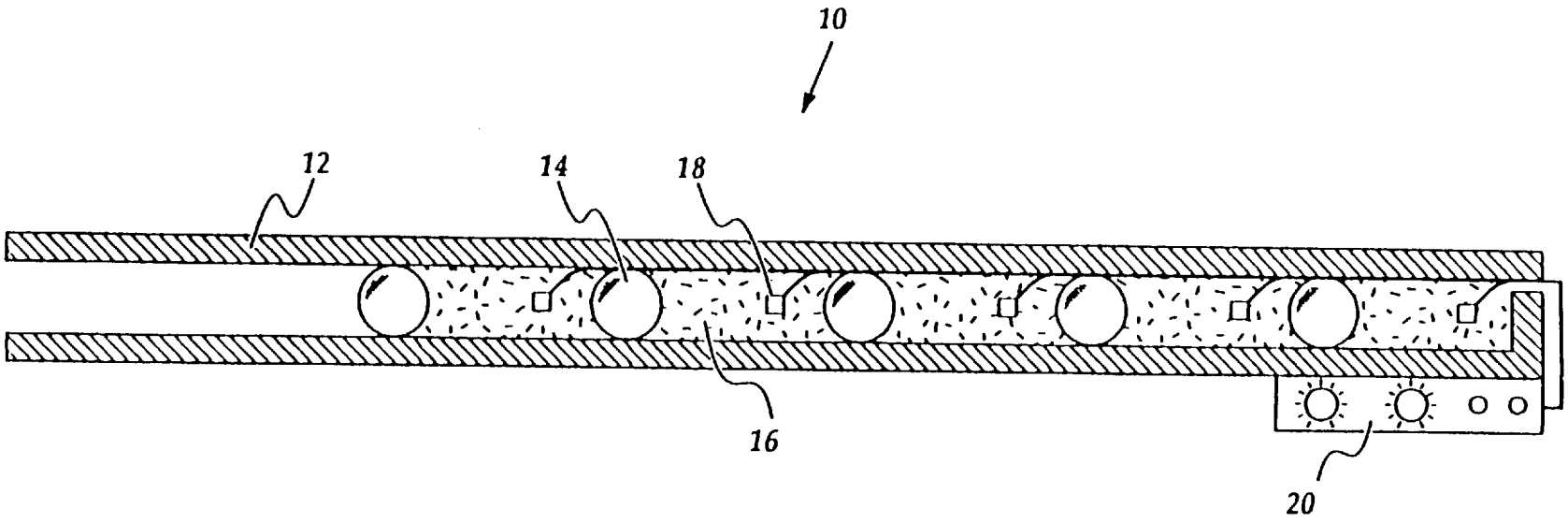
FIG. 1 is a sectional and schematic view of an embodiment of a barrel assembly according to the invention.

Referring to FIG. 1, there is illustrated a barrel assembly 10 including a barrel 12, a plurality of spherical projectiles 14 axially disposed within barrel 12 for operative sealing engagement with the bore of barrel 12, discrete propellant charges 16 disposed between adjacent projectile assemblies 14 for propelling the respective projectile assemblies 14 individually and sequentially through the muzzle of barrel 12, ignition means 18 for igniting discrete propellant charges 16, and control means 20 for selectively and sequentially actuating ignition means 18.

In use, the leading projectile assembly 14 is propelled in response to ignition of the leading propellent charge 16 by the leading ignition means 18. Thereafter the following projectile assemblies are sequentially propelled in like fashion. There is no ammunition delivery system or moving parts, and the firing rate is practically limited only by the time taken for each projectile assembly to exit the barrel.

The control means may have time delay means to control the rapidity of fire and or timing means permitting a selected number of sequential ignitions in response to each manual actuation of the ignition means, such as by squeezing a trigger. A mode switch may be associated with the control means to enable a user to select the form of firing, ie full barrel discharge, short bursts of rapid fire, sequential fire of a selected number of projectiles, single shot firing per actuation etc. Integrated circuit electronic control means are preferably utilised as the control means and may be manufactured as part of the barrel assembly.

Figure 2:
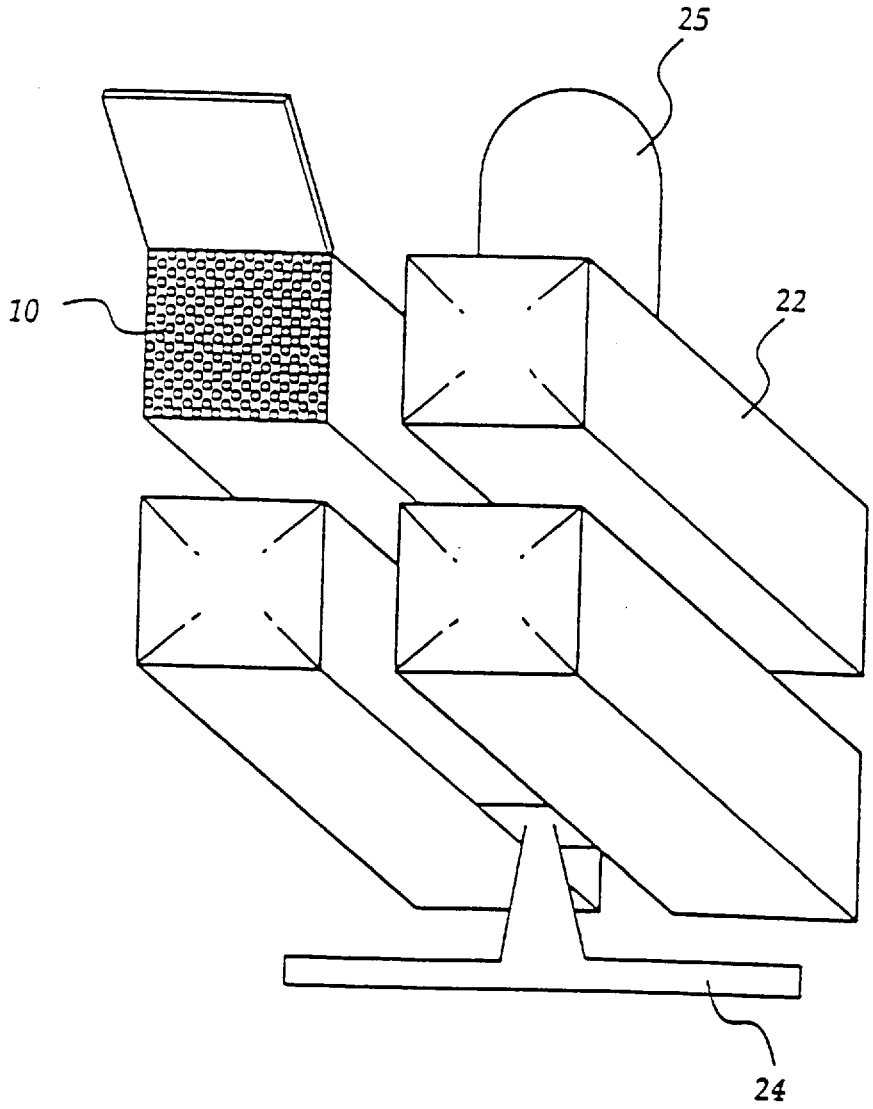
FIG. 2 schematically illustrates the concept of a plurality of barrel assemblies according to the invention being massed in pods.
Figure 3:
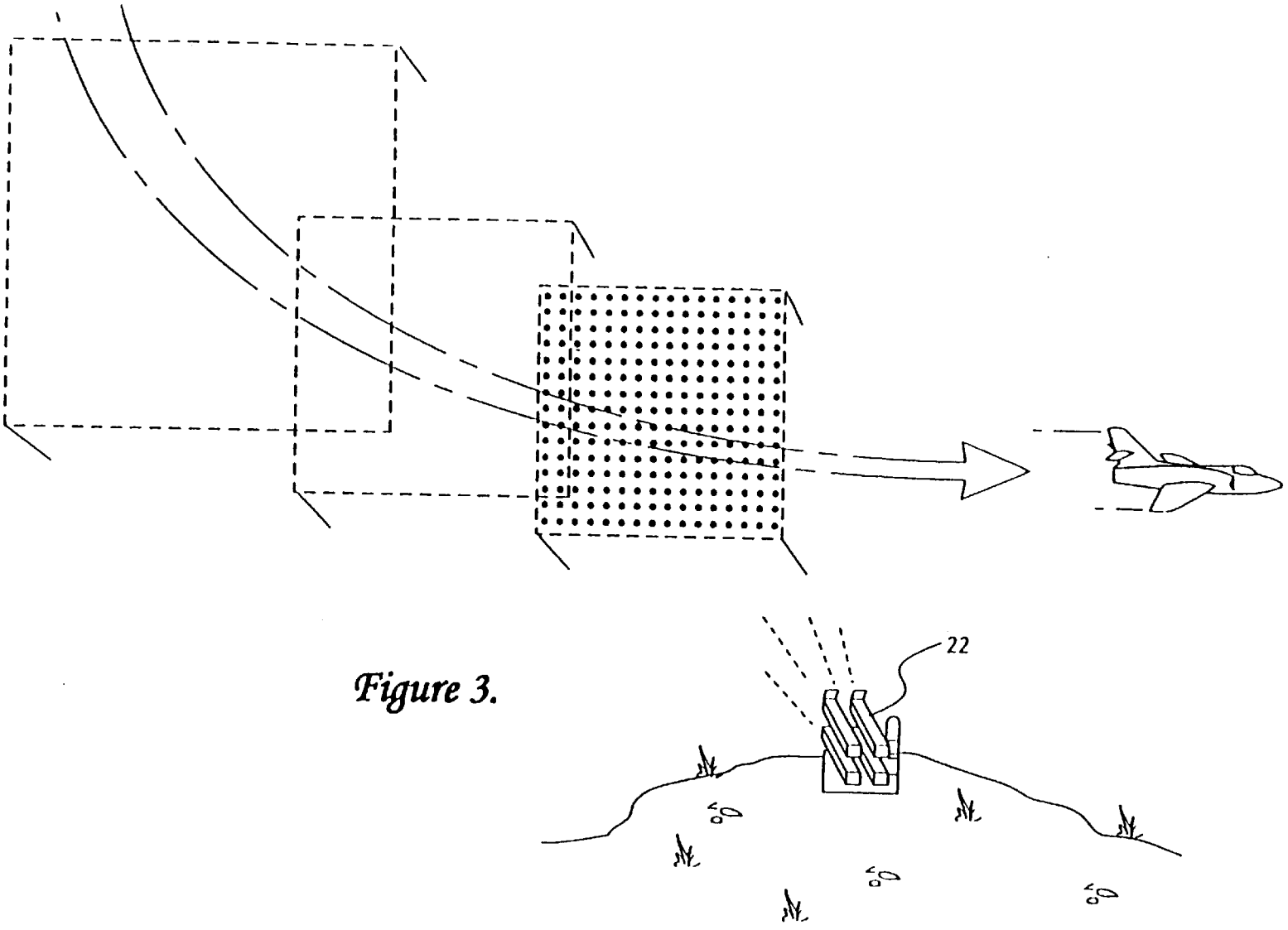
FIG. 3 is a schematic view of arrays of projectile assemblies being fired from the pods of FIG. 2.
Figure 4:
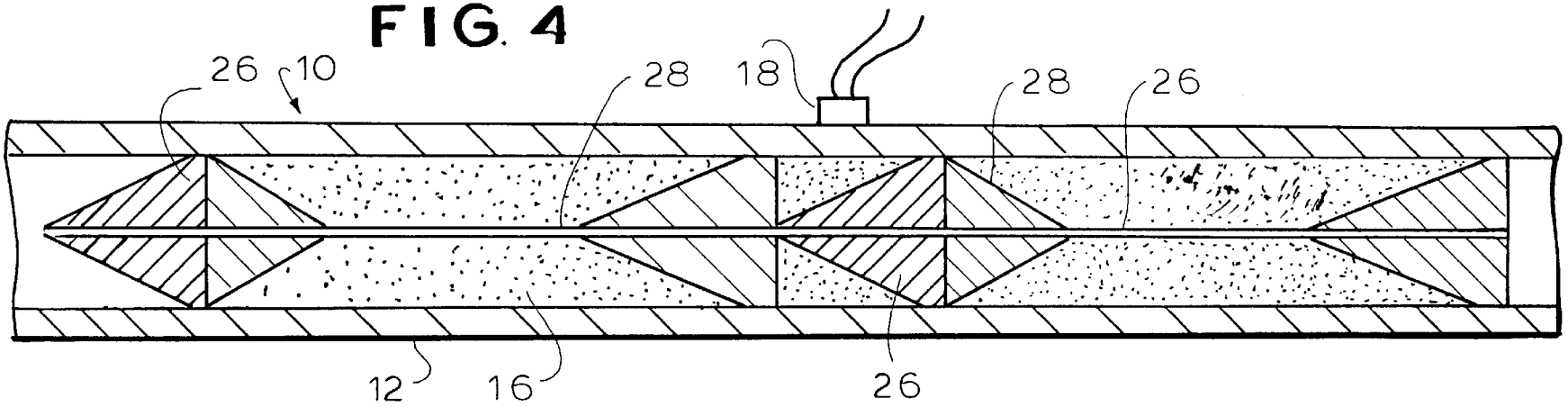
FIG. 4 is a sectional and schematic view of an embodiment of a barrel assembly according to the invention wherein the projectile assembly is in the form of a dart.

Referring to FIG. 2, the barrel assembly constitutes one of a plurality of barrel assemblies and the control means actuates the ignition means of each of the barrel assemblies in such manner that a sequential plurality of arrays of projectile assemblies are propelled in following relationship as shown in FIG. 3. The plurality of barrel assemblies forms a pod 22 and a plurality of pods are mounted on a trainable mount 24. The aiming and firing of the barrel assemblies is controlled by a radar fire control system 25 or other conventional system.

In one form, each barrel is 2.25 metres long and has an outside diameter of 20 mm. The combined propelling charge/projectile assembly length is 50 mm. Leaving 0.25 metres of the barrel free, 40 projectile assemblies together with their associated propellent charges can be pre-loaded into the barrel. The pod has a cross-sectional dimension of 0.75 metres by 0.75 metres for example and therefore accommodates approximately 1200 barrel assemblies. Thus, a pod can be pre-loaded with 48000 projectile assemblies.

This enables significant fire-power to be associated with a relatively small weapon and a very high discharge rate to be achieved, bearing in mind the firing rate of each individual barrel assembly may be significantly in excess of the rate achievable by conventional automatic firearms. The barrel assemblies may be formed as a relatively lightweight honeycomb structure which will be very stiff and if desired the barrels may be arranged to focus at a point relatively close to the weapon with a view to counteracting the spreading tendencies produced by the expansion of the hot explosion gases radiating in an outwards direction. Alternatively a box-like baffle could be used to prevent the immediate outward spread of the gases. This baffle may be slidably supported about the outer barrel section for extension past the end of the barrels during firing. A further manner of alleviating this perceived effect would be to slightly stagger the firing of the projectiles.

Referring to the embodiments of FIGS. 4 to 10, projectile assemblies 14 are disposed in axial abutting relationship to form a compression resistant column. Axially compressive loads are created by the pressures generated in the barrel by the propulsion of preceding projectile assemblies. Compression can result in an alteration of the burn rate of a propelling charge, misalignment of ignition means with respective propelling charges or even premature ignition of propelling charge.

Each projectile assembly 14 includes a projectile head 26 and means for defining a propellant space in the form of spacer assembly 28 which extends axially and rearwardly from projectile head 26 and abuts an adjacent projectile assembly 14.

Projectile head 26 is formed from a heavy malleable material such as lead to facilitate operative sealing with barrel 12, and spacer assembly 28 is formed of a rigid material such as steel.

Figure 5:
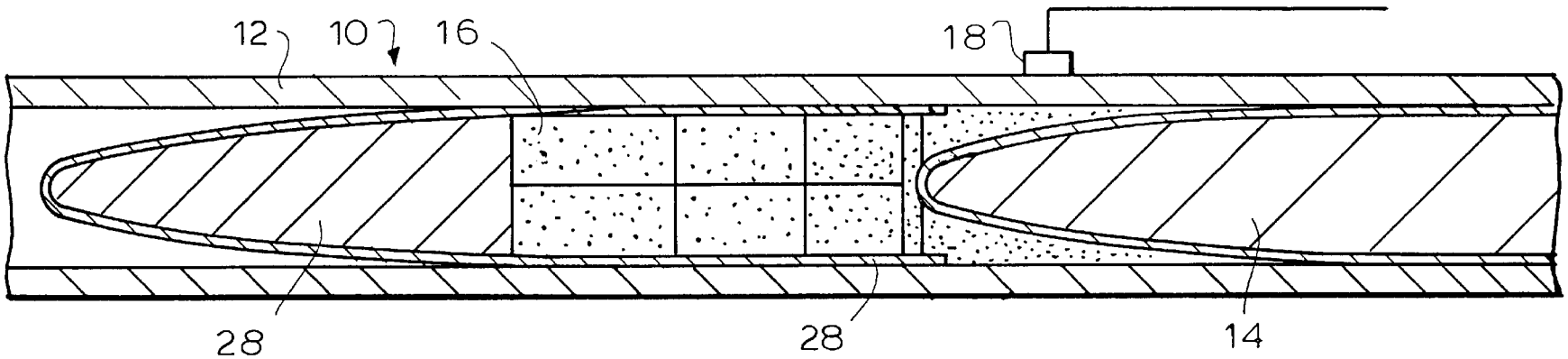
FIG. 5 is a sectional and schematic view of another embodiment of a barrel assembly according to the invention.

In the embodiment of FIG. 5, the spacer assembly 28 takes the form of a cylinder axially extending from projectile head 26. The interior of the cylinder accommodates propellent charge 16 and is structurally reinforced to prevent excessive radial expansion. The end of the cylinder is adapted to abut the leading end of the subsequent projectile assembly 14.

Figure 6:
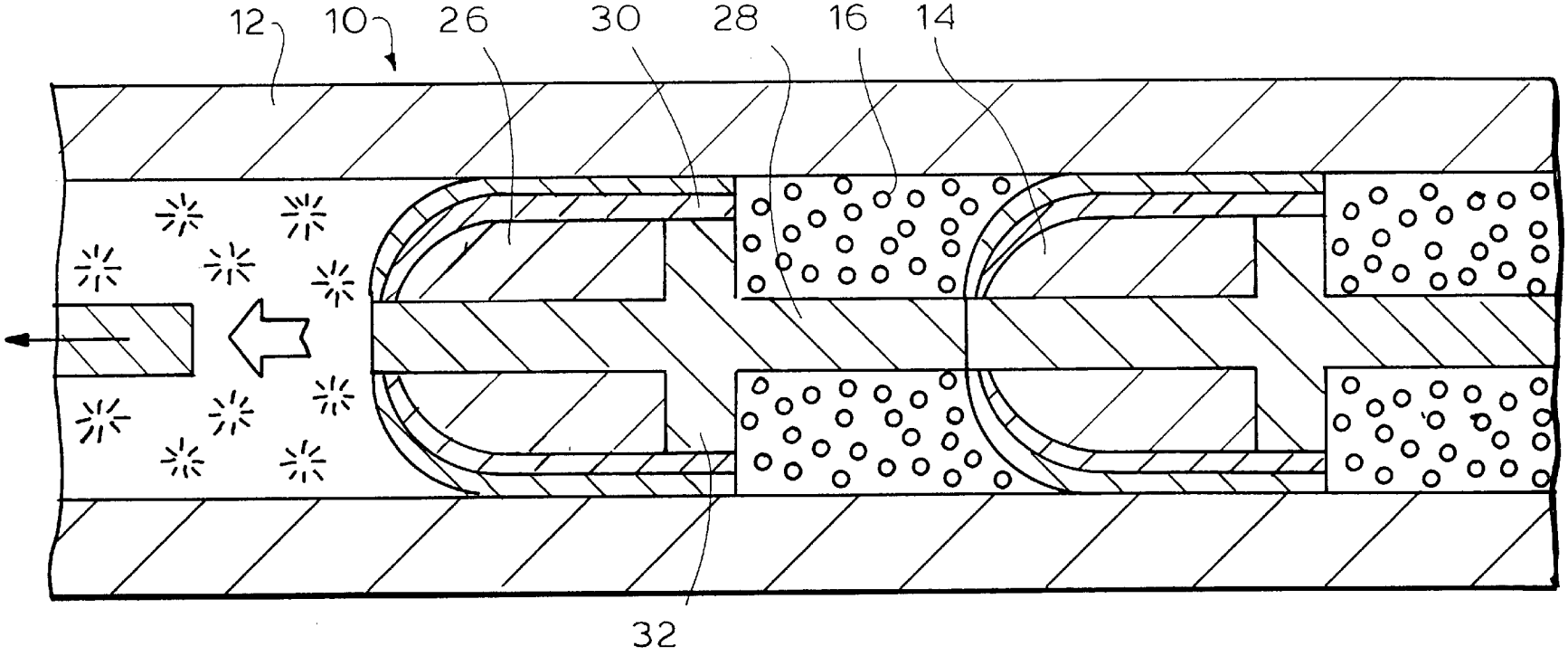
FIG. 6 is a sectional and schematic view of another embodiment of a barrel assembly according to the invention.
Figure 7:
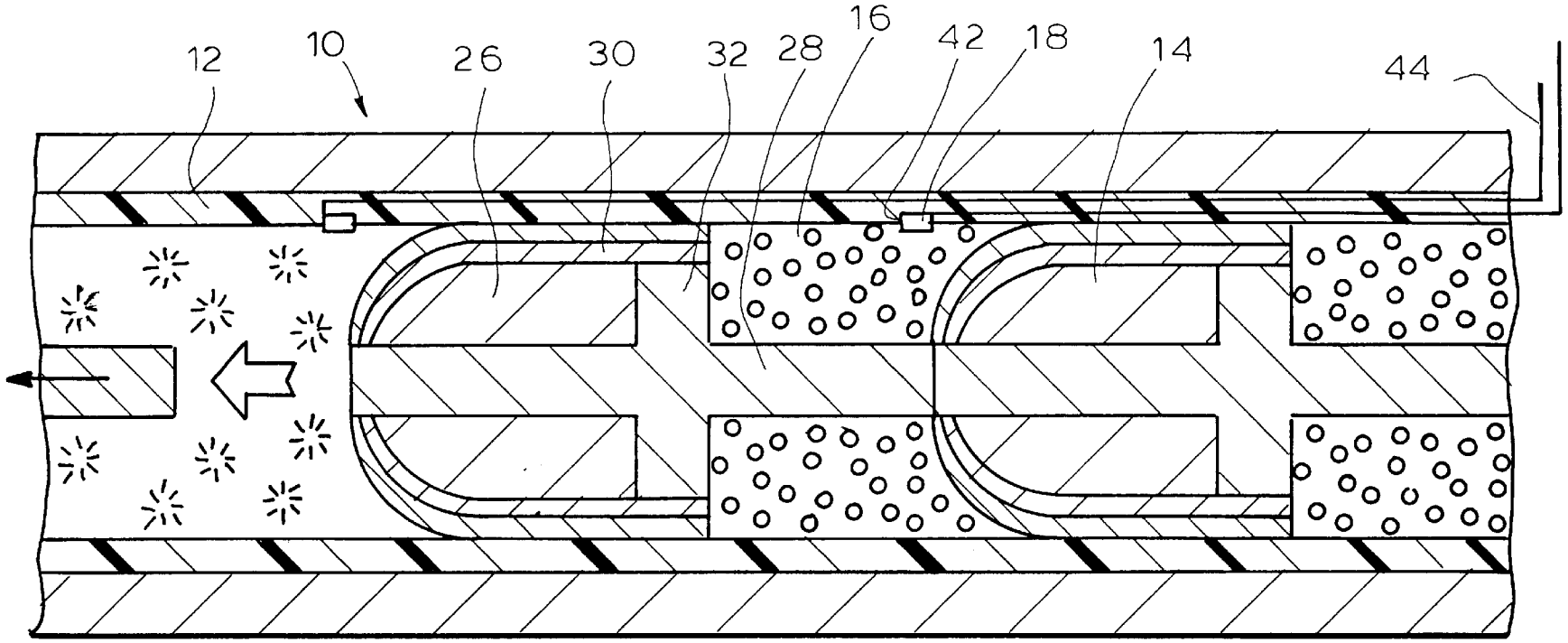
FIG. 7 is a sectional and schematic view of another embodiment of a barrel assembly according to the invention.

Referring to the embodiments of FIGS. 6 and 7, spacer assembly 28 extends through projectile head 26 to the leading end of projectile head 26 whereby compressive loads are transmitted directly between adjacent spacer assemblies 28. Spacer assembly 28 supports a thin cylindrical rear portion 30 of projectile head 26 in operative sealing contact with the bore of barrel 12. Specifically, spacer assembly 28 includes a radially outwardly extending collar flange 32 which supports thin cylindrical rear portion 30 of projectile head 26 in operative sealing contact with the bore of barrel 12.

Figure 9:
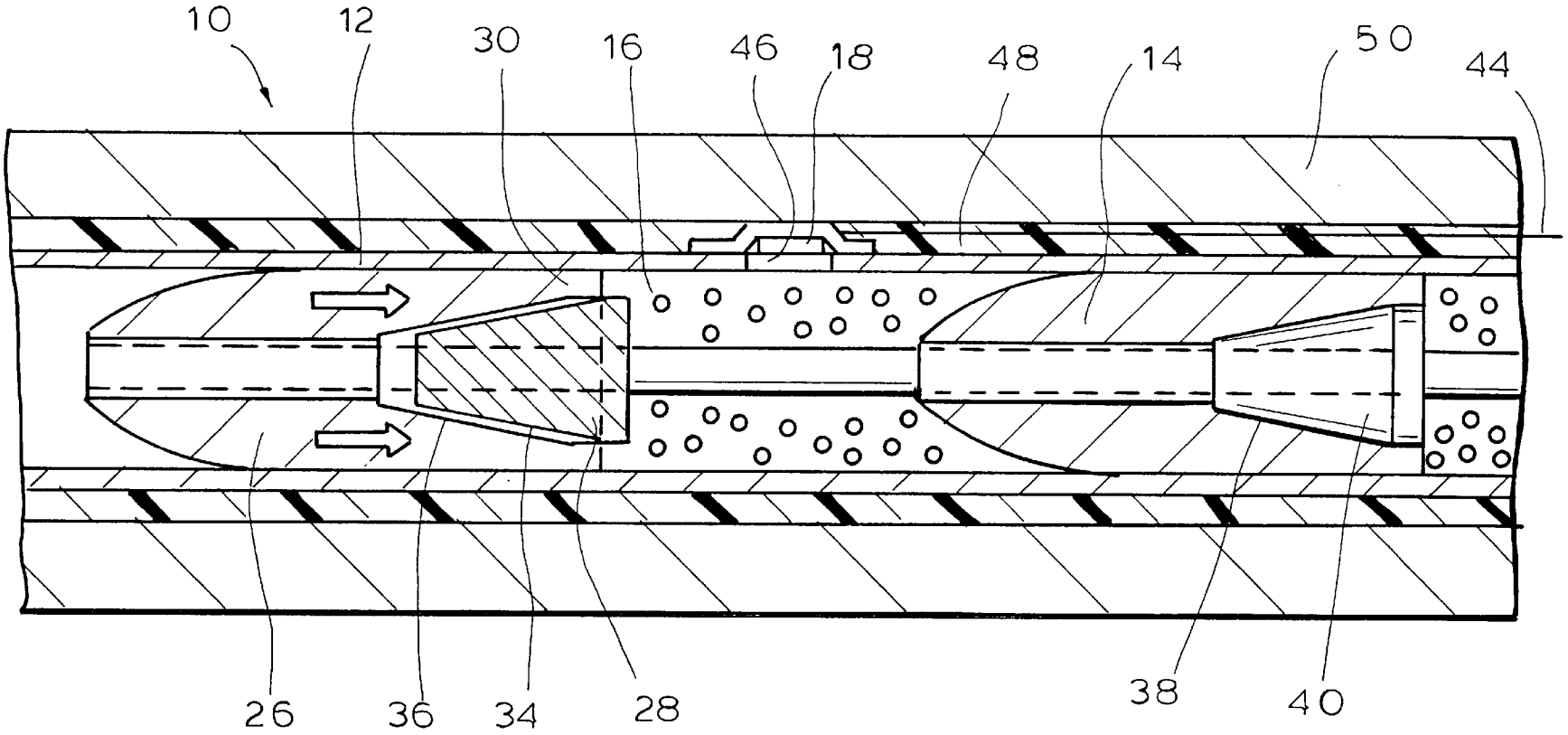
FIG. 9 is a sectional and schematic view of another embodiment of a barrel assembly according to the invention.
Figure 10:
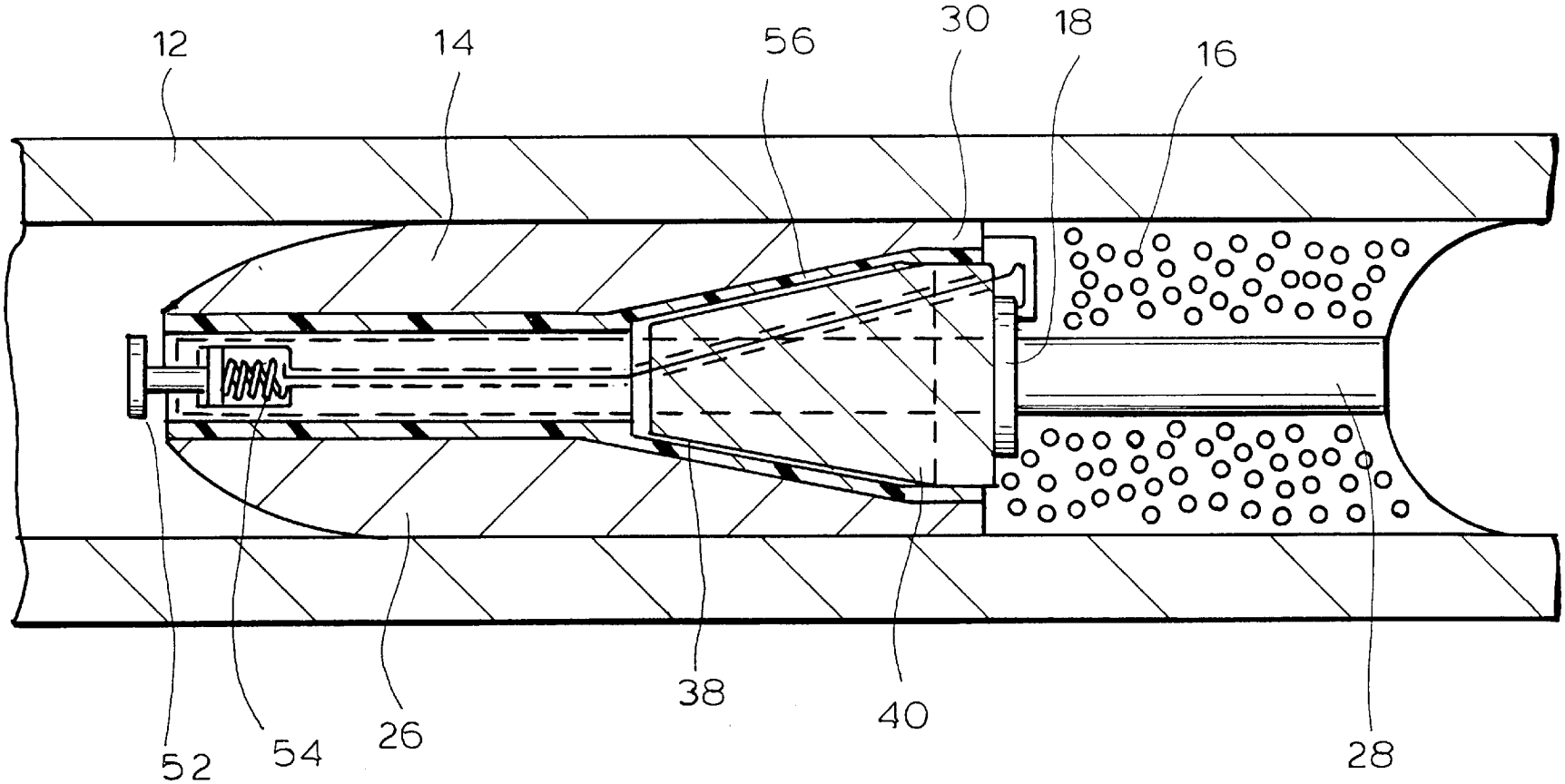
FIG. 10 is a sectional and schematic view of another embodiment of a barrel assembly according to the invention.

Referring to the embodiments of FIGS. 9 and 10, complementary wedging surfaces 34, 36 are disposed on spacer assembly 28 and projectile head 26 respectively whereby thin cylindrical rear portion 30 of projectile head 26 is urged into engagement with the bore of barrel 12 in response to an axially compressive load being applied to projectile assembly 14. Projectile head 26 defines a tapered aperture 38 at its rearward end into which is received a complementary tapered spigot 40 disposed on the leading end of spacer assembly 28. Relative axial movement between tapered aperture 38 and complementary tapered spigot 40 causes a radially expanding force to be applied to thin cylindrical rear portion 30 of projectile head 26.

In the embodiment of FIG. 7, barrel 12 is non-metallic and the bore of the barrel includes recesses 42 which at least partly accommodate ignition means 18. Barrel 12 may be formed of kevlar, carbon fibre, glass reinforced polymer or the like. Thus, the barrel assembly may be lightweight and disposable. Barrel 12 houses electrical conductors 44 which facilitate electrical communication between the control means and ignition means.

Figure 8:
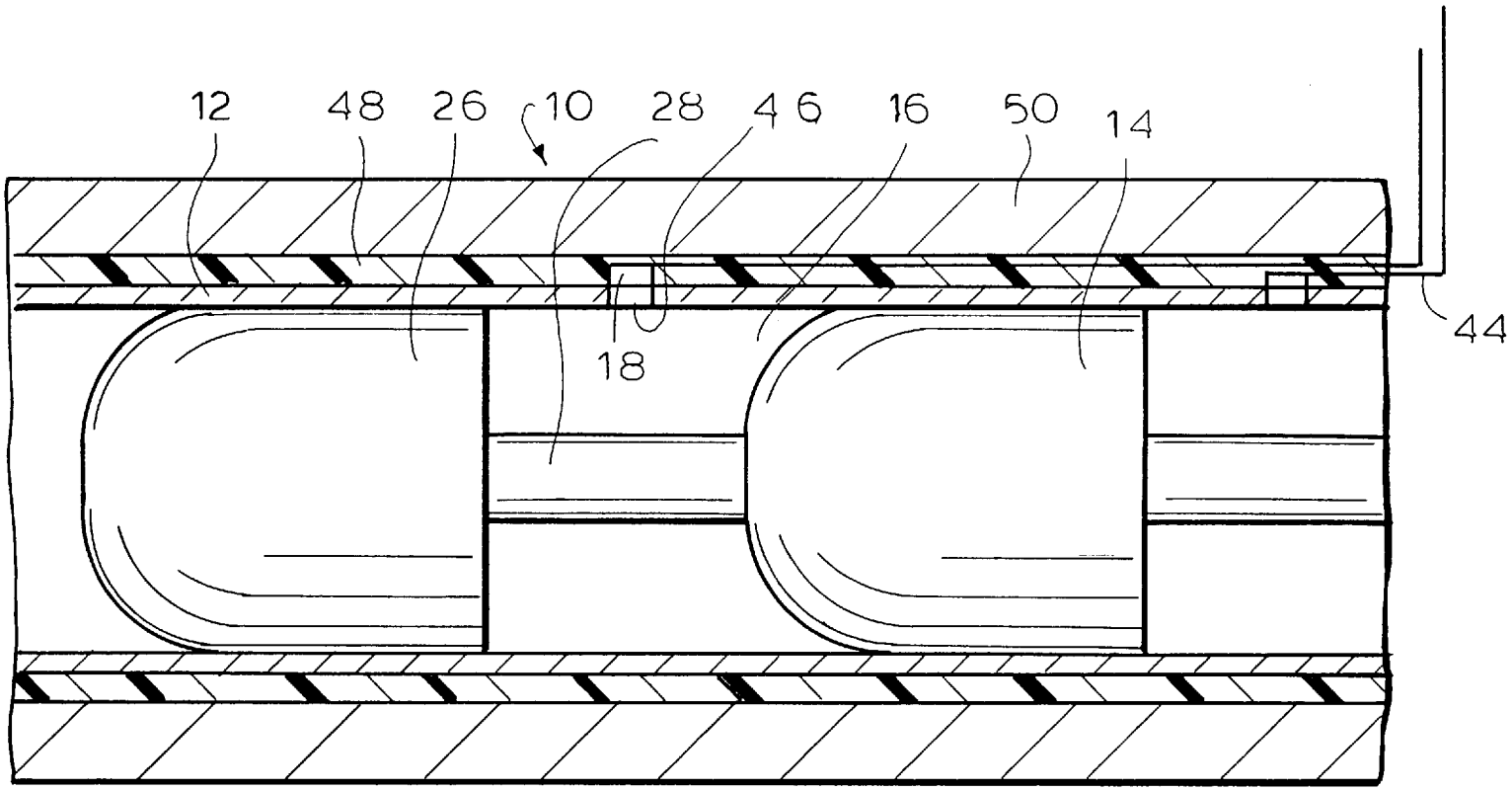
FIG. 8 is a sectional and schematic view of another embodiment of a barrel assembly according to the invention.

In the embodiments of FIGS. 8 and 9, barrel 12 includes ignition apertures 46 and ignition means 18 are disposed outside the barrel and adjacent the apertures. Barrel 12 is surrounded by a non-metallic outer barrel 48, the bore of the outer barrel including recesses adapted to at least partly accommodate the ignition means. The barrel assembly may be slidably received in sheath 50. Outer barrel 48 houses electrical conductors 44 which facilitate electrical communication between the control means and ignition means 18.

Referring to FIG. 10, arming switch 52 associated with ignition means 18 is closed in response to the preceding projectile assembly being discharged. Specifically, arming switch is closed by biasing means 54 once the preceding projectile assembly has been propelled. Projectile head 26 and spacer assembly 28 each constitute switch contacts which are normally electrically isolated from each other by insulating layer 56. An electrical circuit between barrel 12 and spacer assembly 28 is completed when arming switch 52 closes in response to the preceding projectile assembly being discharged. The ignition means 18 is thus armed only when the preceding projectile assembly has been discharged.

Figure 11:
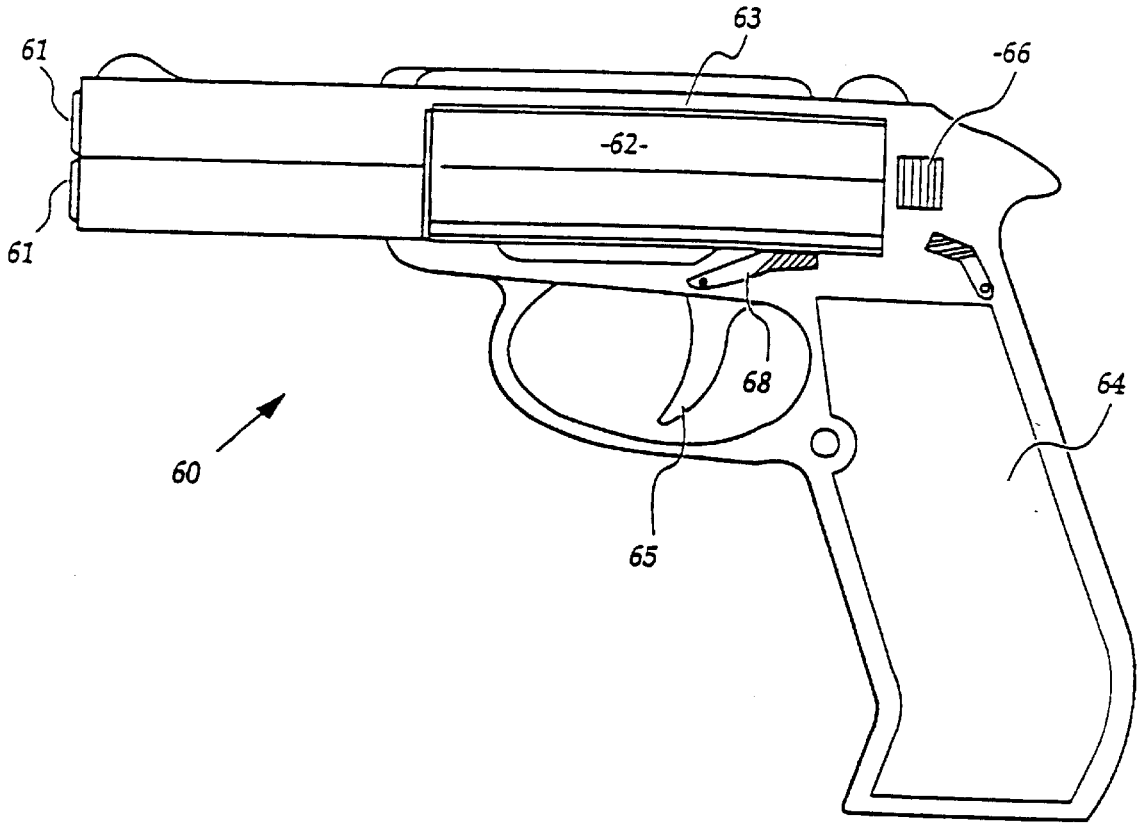
FIG. 11 is a diagrammatic representation of a pistol made in accordance with the present invention.

A four barrel hand gun 60 is illustrated in FIG. 11. The barrels of the four barrel set 61, are arranged in a square formation, and are fed by a matching replaceable four barrel magazine block 62 which slots into a cutout 63 at the base of the barrel set 61. The barrel set 61 is formed integrally with the handgrip 64 which contains the electronic controls for the ignition means.

The four barrel magazine block 62 is loaded with 5 rounds per barrel, which number may of course be varied depending on the size of the block and the size of the round. In this embodiment the magazine block 62 contains twenty rounds.

A variable fire rate and pattern switch 66, is provided for selectively controlling the electronic ignition circuits within the magazine block 62 which connect electrically with the circuits in the hand gun via contacts which meet when the magazine block 62 is slid into position. The switch 66 may be adjusted for electronic control to enable a user to fire individual rounds with each action of the trigger 65, up to four rounds simultaneously, or all rounds automatically on all barrels. A safety catch 68 may also be provided for electrically disabling the weapon. Preferably the cartridges are disposable and may be provided in different formats so that a user may select and/or quickly change the type of rounds to be fired.

Figure 12:
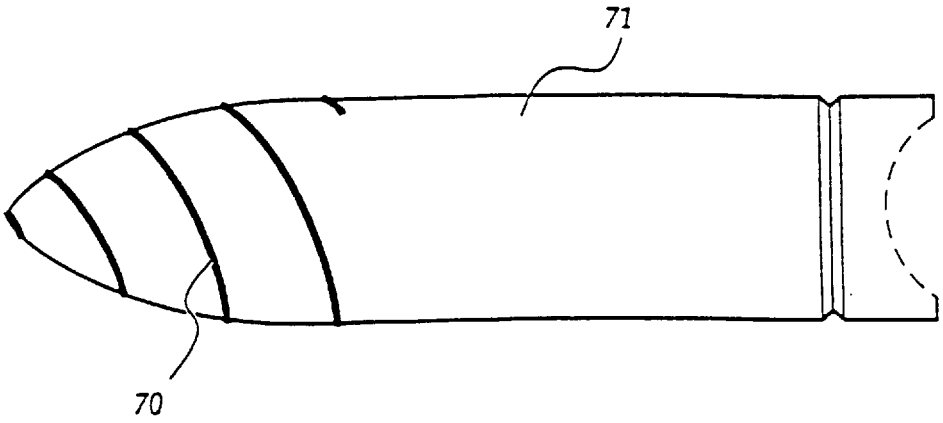
FIGS. 12 and 13 illustrate an alternate form of projectile.
Figure 13:
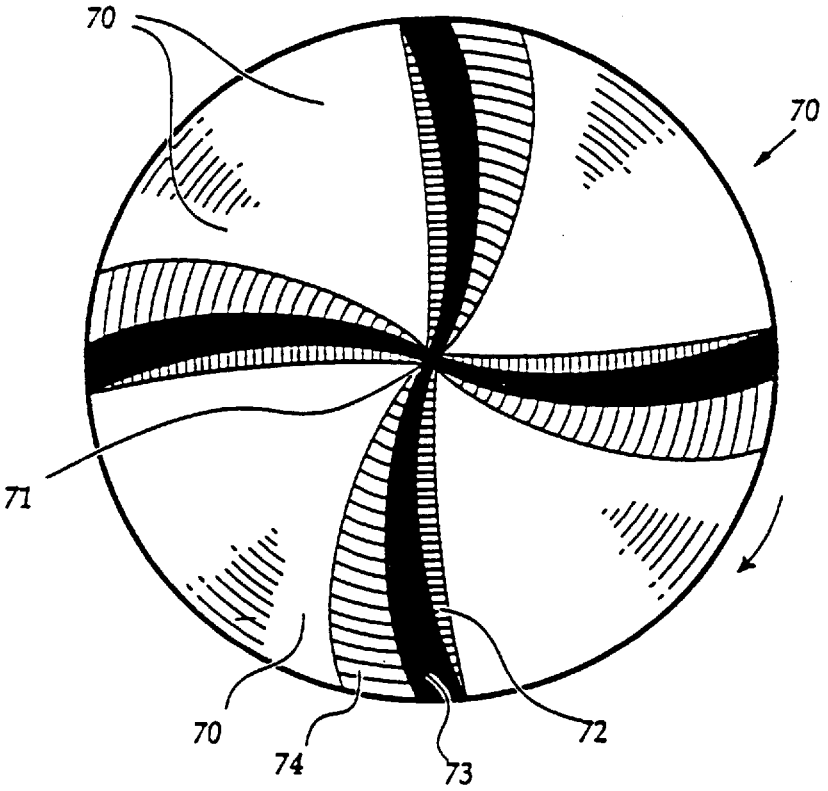

The projectiles for use with the above described embodiments may be provided with external flights or spiral ridges as illustrated in FIGS. 12 and 13. The ridges 70 are provided on the nose of the projectile to impart spin during flight. In the form illustrated a 7.62 mm bullet 71 has four spiraling ridges 70 radiating from the nose of the bullet. The ridges are of an average height of 1.5 mm and extend the length of the nose of the bullet, but not along the side of the bullet. The pitch is suitably formed as to provide a single revolution of the bullet about its longitudinal axis for every meter travelled.

Of course two or more spiraling ridges, spaced evenly around the bullet nose may be utilised if desired. Furthermore the height of the ridges, the length of the ridges, the pitch or degree of spiraling, the geometric curve form of the spiral, may be varied to suit the desired flight characteristics. The ridges may also extend along the side of the bullet. The cross section profile of the spiral ridges may be relatively flat, or steep according to the intended use of the ammunition, and the desired degree of reaction to the airflow.

As illustrated in FIG. 13, the ridges 70 may have a steep leading face 72, which offers resistance to the airflow over the bullet, and causes the bullet to rotate, a flat top portion 73 and trailing faces 74 which slope gently to the surface of the bullet.

Such ammunition may also be used in rifled barrel weapons to advantage. Also as the spirals on the bullet would assist in producing the spin during firing, the normal pressure applied by the edge of the rifling lands against the soft metal of the bullet would be reduced. Therefore the bullet would not require the rifling to cut as long a track along the side of the bullet. Rather, the small expanding band of the Minie gas sealing system would then be adequate to assist with spin acceleration. On impact with soft targets, the spiral bullet of the present invention would tend to react to the increased pressure on the ridges by maintaining a high rate of twist, as it progresses through the target material.

It will of course be realised that the above has been given only by way of illustrative example of the invention, and that all such modifications and variations thereto as would be apparent to persons skilled in the art are deemed to fall within the broad ambit and scope of the invention as is herein set forth.

I claim:

1. A barrel assembly including:

a barrel;

a plurality of projectile assemblies axially disposed in end to end abutting relationship within said barrel in sealing engagement with the bore of said barrel, said plurality of projectile assemblies being disposed in axial abutting relationship to form a compression resistant column, each projectile assembly including a projectile head and extension means for at least partly defining a propellant space, said extension means including a spacer assembly which extends axially from said projectile head and abuts an adjacent projectile assembly, said spacer assembly extending through said projectile head;

discrete propellant charges associated with each projectile assembly for propelling respective projectile assemblies sequentially through the muzzle of said barrel;

ignition means for igniting said discrete propellant charges; and control means for selectively and sequentially actuating said ignition means.

2. A barrel assembly as defined in claim 1, wherein the barrel assembly includes an arming switch associated with each ignition means which is closed in response to the preceding projectile assembly being discharged.

3. A barrel assembly as defined in claim 2, wherein the arming switch is closed by biasing means which are normally resisted by the preceding projectile assembly.

4. A barrel assembly as defined in claim 2, wherein the projectile head and spacer assembly each constitute switch contacts which are normally electrically isolated from each other and wherein an electrical circuit between the barrel and spacer body is completed in response to the preceding projectile assembly being discharged.

5. A barrel assembly including:

a barrel;

a plurality of projectile assemblies axially disposed in end to end abutting relationship within said barrel in sealing engagement with the bore of said barrel, said plurality of projectile assemblies being disposed in axial abutting relationship to form a compression resistant column, each projectile assembly including a projectile head and extension means for at least partly defining a propellant space, said extension means including a spacer assembly which extends axially from said projectile head and abuts an adjacent projectile assembly, said spacer assembly supporting a thin cylindrical rear portion of said projectile head in operative sealing contact with the bore of said barrel;

discrete propellant charges associated with each projectile assembly for propelling respective projectile assemblies sequentially through the muzzle of said barrel;

ignition means for igniting said discrete propellant charges; and control means for selectively and sequentially actuating said ignition means.

6. A barrel assembly as defined in claim 5, wherein the spacer assembly includes a radially outwardly extending collar which maintains the thin cylindrical rear portion of the projectile head in operative sealing contact with the bore of the barrel.

7. A barrel assembly as defined in claim 6, wherein the projectile head is formed from a heavy malleable material and the spacer assembly is formed of a rigid material.

8. A barrel assembly including:

a barrel;

a plurality of projectile assemblies axially disposed in end to end abutting relationship within said barrel in sealing engagement with the bore of said barrel, said plurality of projectile assemblies being disposed in axial abutting relationship to form a compression resistant column, each projectile assembly including a projectile head and extension means for at least partly defining a propellant head and extension means for at least partly defining a propellant space, said extension means including a spacer assembly which extends axially from said projectile head and abuts an adjacent projectile assembly, the complementary wedging surfaces being disposed on said spacer assembly and projectile head, respectively, said projectile head and spacer assembly being loaded into said barrel, and thereafter an axially compressive load being applied to ensure good sealing between said projectile head and the barrel, said projectile head defining a tapered aperture at its rearward end into which is received a complementary tapered spigot disposed on the leading end of the spacer assembly such that relative axial movement between the tapered aperture and the complementary tapered spigot causes a radially expanding force to be applied to the projectile heads;

discrete propellant charges for propelling respective projectile assemblies sequentially through the muzzle of said barrel;

ignition means for igniting said discrete propellant charges; and control means for selectively and sequentially actuating said ignition means.

9. A barrel assembly including:

a barrel;

a plurality of projectile assemblies axially disposed in end to end abutting relationship within said barrel in sealing engagement with the bore of said barrel;

discrete propellant charges for propelling respective projectile assemblies sequentially through the muzzle of said barrel;

ignition means for igniting said discrete propellant charges; and control means for selectively and sequentially actuating said ignition means;

said barrel including ignition apertures and said ignition means being disposed outside said barrel and adjacent apertures.

10. A barrel assembly as defined in claim 9, wherein the barrel is surrounded by a non-metallic outer barrel, the bore of the outer barrel including recesses adapted to at least partly accommodate the ignition means, and wherein the outer barrel houses electrical conductors which facilitate electrical communication between the control means and ignition means.

11. A barrel assembly of the type having including a barrel, a plurality of projectile assemblies disposed in end to end abutting relationship within said barrel, discrete propellant charges associated with each projectile assembly for propelling respective projectile assemblies sequentially through the muzzle of said barrel, ignition means for igniting said discrete propellant charges, and control means for selectively and sequentially actuating said ignition means, wherein:

each projectile assembly includes a projectile head arranged in sealing engagement with the bore of said barrel and a spacer assembly which extends through said projectile head and rearwardly therefrom;

each said discrete propellant charge is disposed in a propellant space surrounding a respective rearward extension of said spacer assemblies, and said spacer assemblies extend in end to end abutting relationship to form a compression resistant column which positions said projectile assemblies and their propellant charges within said barrel.

12. A barrel assembly as defined in claim 11, wherein each said spacer assembly supports a thin cylindrical rear portion of the respective projectile head in sealing contact with said bore.

13. A barrel assembly as defined in claim 12, wherein each said spacer assembly includes a radially outwardly extending collar which maintains the thin cylindrical rear portion of said projectile head in operative sealing contact with said bore.

14. A barrel assembly as defined in claim 13, wherein said projectile head is formed from a heavy malleable material and said spacer assembly is formed of a rigid material.

15. A barrel assembly as defined in claim 11, wherein complementary wedging surfaces are disposed on said spacer assembly and in said projectile head of each said projectile assembly for wedging said projectile head into sealing engagement with said barrel.

16. A barrel assembly as defined in claim 15, wherein said complementary wedging surfaces include a tapered socket in the rear end of each said projectile head which receives a complementary tapered spigot disposed adjacent the leading end of said spacer assembly, wherein relative axial movement between said tapered socket and said complementary tapered spigot causes a radially expanding force to be applied to said projectile head for wedging said projectile head into sealing engagement with said barrel.

17. A barrel assembly as defined in claim 16, wherein said projectile assemblies are loaded into said barrel and thereafter an axially compressive load is applied to expand said projectile heads along the respective wedging surfaces of said spacer assemblies to ensure operative sealing between each said projectile head and said barrel.

18. A barrel assembly as defined in claim 11, wherein said barrel is non-metallic and said bore includes recesses which at least partly accommodate said ignition means and wherein said barrel houses electrical conductors which facilitate electrical communication between said control means and ignition means.

19. A barrel assembly as defined in claim 18, wherein said barrel is an outer barrel which surrounds an inner barrel supporting said projectile assemblies.

20. A barrel assembly as defined in claim 19, wherein said inner barrel includes ignition apertures for said ignition means.

21. A barrel assembly as defined in claim 11, wherein said barrel assembly includes an arming switch associated with each ignition means which is closed in response to the preceding projectile assembly being discharged.

22. A barrel assembly as defined in claim 21, wherein said arming switch is closed by biasing means which is normally resisted by said preceding projectile assembly.

23. A barrel assembly as defined in claim 22, wherein each said projectile head and spacer assembly constitute switch contacts which are normally electrically isolated from each other and wherein an electrical circuit between said barrel and spacer body is completed in response to said preceding projectile assembly being discharged.

24. A barrel assembly as defined in claim 11, wherein said barrel assembly constitutes one of a plurality of barrel assemblies and said control means actuates said ignition means of each of said barrel assemblies in such manner that a plurality of arrays of projectile assemblies are sequentially propelled in a following relationship.

25. A barrel assembly of the type having including a barrel, a plurality of projectile assemblies disposed in end to end abutting relationship within said barrel, discrete propellant charges associated with each projectile assembly for propelling respective projectile assemblies sequentially through the muzzle of said barrel, ignition means for igniting said discrete propellant charges, and control means for selectively and sequentially actuating said ignition means, wherein;

each projectile assembly includes a projectile head arranged in sealing engagement with the bore of the barrel and a spacer assembly which extends through said projectile head and rearwardly therefrom;

said spacer assemblies of said projectile assemblies abut one another to form a compression resistant column, and the rear end of each said projectile head is formed with a tapered socket which receives a complementary tapered spigot disposed adjacent the leading end of the mating spacer assembly, wherein relative rearward axial movement of a said projectile head along its spacer assembly moves said tapered socket over said complementary tapered spigot and causes a radially expanding force to be applied to said projectile head for wedging said projectile head into sealing engagement with said barrel.

26. A barrel assembly as defined in claim 25, wherein said barrel assembly constitutes one of a plurality of barrel assemblies and said control means actuates said ignition means of each of said barrel assemblies in such manner that a plurality of arrays of projectile assemblies are sequentially propelled in a following relationship.

* * * * *

UNITED STATES PATENT AND TRADEMARK OFFICE

CERTIFICATE OF CORRECTION

PATENT NO. : 5,883,329

DATED : March 16, 1999

INVENTOR(S) : James Michael O'Dwyer

It is certified that error appears in the above-indentified patent and that said Letters Patent is hereby corrected as shown below:

Column 8, lines 26-27, delete

"for at least partly defining a propellant head and extension means"

Signed and Sealed this

Eleventh Day of April, 2000

*Attest:*

Q. TODD DICKINSON

*Attesting Officer*

*Director of Patents and Trademarks*